US009497846B2

(12) United States Patent
Szatkowski et al.

(10) Patent No.: US 9,497,846 B2
(45) Date of Patent: Nov. 15, 2016

(54) PLASMA GENERATOR USING SPIRAL CONDUCTORS

(71) Applicant: The United States of America as represented by the Administrator of the National Aeronautics and Space Administration, Washington, DC (US)

(72) Inventors: George N. Szatkowski, Charlottesville, VA (US); Kenneth L. Dudley, Newport News, VA (US); Larry A. Ticatch, Yorktown, VA (US); Laura J. Smith, Yorktown, VA (US); Sandra V. Koppen, Suffolk, VA (US); Truong X. Nguyen, Hampton, VA (US); Jay J. Ely, Yorktown, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 14/520,679

(22) Filed: Oct. 22, 2014

(65) Prior Publication Data

US 2015/0115798 A1 Apr. 30, 2015

Related U.S. Application Data

(60) Provisional application No. 61/895,099, filed on Oct. 24, 2013.

(51) Int. Cl.
*H05H 1/46* (2006.01)
*H05H 1/24* (2006.01)

(52) U.S. Cl.
CPC ..... *H05H 1/46* (2013.01); *H05H 1/2406* (2013.01); *H05H 2001/2412* (2013.01); *H05H 2001/2456* (2013.01)

(58) Field of Classification Search
CPC .... H01J 37/321; H01J 37/04; H01J 37/3211; H01J 37/32532; H05H 1/46; H05H 1/2406; H05H 2001/2412; H05H 2001/2456; H04Q 9/00; G01R 33/1223; G06F 17/10; G06F 17/5009; G21B 1/00; H01F 17/0006; H01F 2017/0073
USPC ..... 315/111.21–111.71
See application file for complete search history.

(56) References Cited

U.S. PATENT DOCUMENTS 5,349,271 A * 9/1994 van Os et al. ..... 315/248
5,436,528 A 7/1995 Paranjpe (Continued)

FOREIGN PATENT DOCUMENTS

GB 2293050 A 3/1996

OTHER PUBLICATIONS

PCT International Search Report PCT/US2014/062124, pp. 1-10, Jun. 2, 2015.

(Continued)

*Primary Examiner* — Alexander H Taningco
*Assistant Examiner* — Seokjin Kim
(74) *Attorney, Agent, or Firm* — Robin W. Edwards

(57) ABSTRACT

A plasma generator includes a pair of identical spiraled electrical conductors separated by dielectric material. Both spiraled conductors have inductance and capacitance wherein, in the presence of a time-varying electromagnetic field, the spiraled conductors resonate to generate a harmonic electromagnetic field response. The spiraled conductors lie in parallel planes and partially overlap one another in a direction perpendicular to the parallel planes. The geometric centers of the spiraled conductors define endpoints of a line that is non-perpendicular with respect to the parallel planes. A voltage source coupled across the spiraled conductors applies a voltage sufficient to generate a plasma in at least a portion of the dielectric material.

26 Claims, 2 Drawing Sheets

(56) References Cited

U.S. PATENT DOCUMENTS

| | | | | |
|---|---|---|---|---|
| 5,874,704 | A * | 2/1999 | Gates | 219/121.43 |
| 7,086,593 | B2 | 8/2006 | Woodard et al. | |
| 7,159,774 | B2 | 1/2007 | Woodard et al. | |
| 8,430,327 | B2 | 4/2013 | Woodard et al. | |
| 2004/0019272 | A1 | 1/2004 | Witcraft | |
| 2005/0007239 | A1 | 1/2005 | Woodard et al. | |
| 2007/0181683 | A1 | 8/2007 | Woodard | |
| 2008/0184795 | A1 | 8/2008 | Woodard et al. | |
| 2009/0040116 | A1 | 2/2009 | Eray | |
| 2009/0072814 | A1 | 3/2009 | Woodard et al. | |
| 2009/0109005 | A1 | 4/2009 | Woodard et al. | |
| 2009/0273429 | A1* | 11/2009 | Nakamura et al. | 336/200 |
| 2009/0302111 | A1 | 12/2009 | Woodard et al. | |
| 2010/0026202 | A1* | 2/2010 | Siessegger | 315/287 |
| 2010/0059692 | A1 | 3/2010 | Quick, II | |
| 2010/0109818 | A1 | 5/2010 | Woodard et al. | |
| 2011/0274139 | A1 | 11/2011 | Woodard et al. | |
| 2011/0292969 | A1 | 12/2011 | Woodard | |
| 2012/0271564 | A1 | 10/2012 | Dudley et al. | |
| 2013/0033271 | A1 | 2/2013 | Woodard | |

OTHER PUBLICATIONS

PCT International Search Report PCT/US2014/062102, pp. 1-12, Oct. 2, 2015.

PCT International Search Report PCT/US2014/062097, pp. 1-12, Oct. 24, 2014.

Dudley et al. Damage Detection Response Characteristics of Open Circuit Resonant (SansEC) Sensors. 2013 ICOLSE International Conference on Lightning and Static Electricity, Sep. 17-20, 2013, pp. 1-13, Seattle, Washington.

Urrutia, et al. "Nonlinear electron magnetohydrodynamic physics. VI. Magnetic loop antenna across the ambient field", Phys Plasmas, 2009, vol. 16, pp. 022102-1-022102-10.

Woodard, Stanley E., "A Magnetic Field Response Recorder: A New Tool For Measurement Acquisition," 5th Annual IEEE Conference on Sensors, Oct. 22-25, 2006, pp. 789-797, Daegu, Korea.

Woodard, Stanley E. et al., "Measurement of Multiple Unrelated Physical Quantities using a Single Magnetic Field Response Sensor" Measurement Science and Technology, 2007, vol. 18, pp. 1603-1613.

Smith, Douglas C. et al., "Signal and Noise Measurement Techniques Using Magnetic Field Probes," 1999 IEEE International Symposium on Electromagnetic Compatibility, Aug. 2-6, 1999, pp. 559-563, Seattle Washington.

Ely, Jay J. et al. "Investigation of Electromagnetic Field Threat to Fuel Tank Wiring of a Transport Aircraft," Mar. 2000, NASA/TP-2000-209867, pp. 1-200.

ETS Lindgren, Model 7405 Near-Field Probe Set User Manual, 1999, pp. 1-51.

* cited by examiner

PLASMA GENERATOR USING SPIRAL CONDUCTORS

CROSS-REFERENCE TO RELATED PATENT APPLICATION(S)

This patent application claims the benefit of and priority to U.S. Provisional Application Ser. No. 61/895,099, filed on Oct. 24, 2013, the contents of which are hereby incorporated by reference in their entirety. In addition, this application is related to co-pending patent applications titled "MULTI-LAYER WIRELESS SENSOR CONSTRUCT FOR USE AT ELECTRICALLY-CONDUCTIVE MATERIAL SURFACES," U.S. patent application Ser. No. 14/520,785 and "ANTENNA FOR FAR FIELD TRANSCEIVING," U.S. patent application Ser. No. 14/520,863, filed on the same day and owned by the same assignee as this patent application, the contents of which are hereby incorporated by reference in their entirety.

STATEMENT REGARDING FEDERALLY SPONSORED RESEARCH OR DEVELOPMENT

The invention described herein was made in the performance of work under a NASA contract and by employees of the United States Government and is subject to the provisions of Public Law 96-517 (35 U.S.C. §202) and may be manufactured and used by or for the Government for governmental purposes without the payment of any royalties thereon or therefore. In accordance with 35 U.S.C. §202, the contractor elected not to retain title.

BACKGROUND OF THE INVENTION

The four fundamental states of matter are solids, liquids, gases, and plasmas. Briefly, when one of a solid, liquid, or gas is ionized, a plasma forms. Plasma occurs naturally (e.g., lightning) and in man-made devices (e.g., rear lights, plasma globes, etc.). In either case, a plasma contains a large number of charge carriers thereby making it electrically conductive. Accordingly, a man-made plasma generator can be useful in a wide variety of applications.

BRIEF SUMMARY OF THE INVENTION

The present invention is a plasma generator that includes a first electrical conductor having first and second ends. The first electrical conductor is shaped to form a first spiral between its first and second ends, with the first spiral lying in a first plane and having a geometric center. The first electrical conductor so-shaped has inductance and capacitance wherein, in the presence of a time-varying electromagnetic field, the first electrical conductor so-shaped resonates to generate a harmonic electromagnetic field response. The plasma generator also includes a second electrical conductor having first and second ends. The second electrical conductor is shaped to form a second spiral between its first and second ends with the second spiral being identical to the first spiral, lying in a second plane parallel to the first plane, and having a geometric center. The second electrical conductor so-shaped has inductance and capacitance wherein, in the presence of a time-varying electromagnetic field, the second electrical conductor so-shaped resonates to generate a harmonic electromagnetic field response. The first spiral and second spiral partially overlap one another in a direction perpendicular to the first plane and second plane.

The geometric center of the first spiral and geometric center of the second spiral define endpoints of a line that is non-perpendicular with respect to the first plane and second plane. Dielectric material is disposed between the first electrical conductor and second electrical conductor. A voltage source coupled across the first electrical conductor and second electrical conductor applies a voltage sufficient to generate a plasma in at least a portion of the dielectric material.

These and other features, advantages, and objects of the present invention will be further understood and appreciated by those skilled in the art by reference to the following specification, claims, and appended drawings.

DETAILED DESCRIPTION OF THE INVENTION

Figure 1:
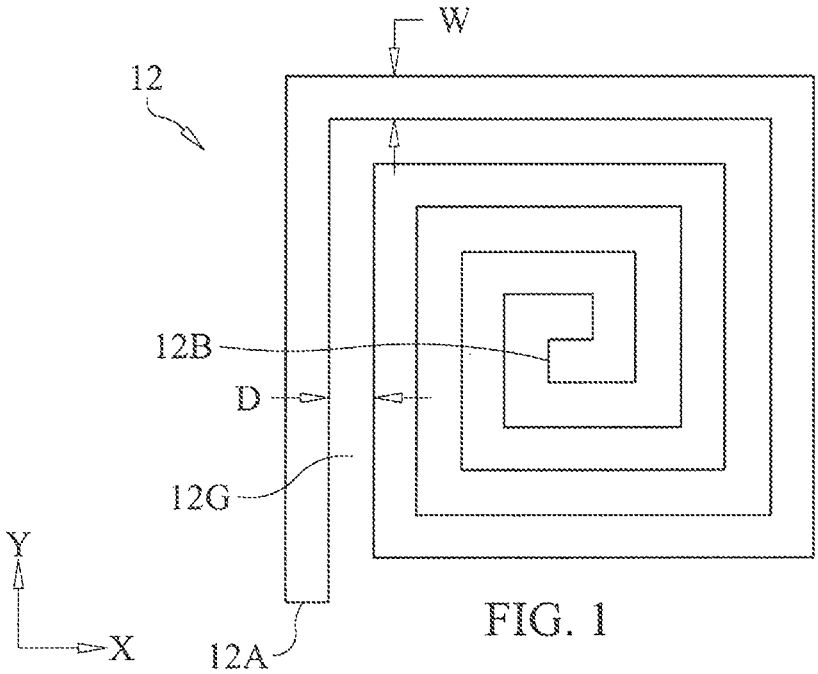
FIG. 1 is a plan view of a single spiraled electrical conductor for use in an embodiment of a plasma generator in accordance with the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions, relative dimensions, and/or other physical characteristics relating to the embodiments disclosed herein are not to be considered as limiting, unless the claims expressly state otherwise.

The present invention is a plasma generator that uses spiral electrical conductors. The plasma generator of the present invention can be used in a number of applications to include sensing applications, antenna applications, electric current conducting applications, and lighting (i.e., visible and non-visible spectrums) applications, just to name a few. Before describing the plasma generator of the present invention, an exemplary spiral electrical conductor used by the present invention will be illustrated and described.

Referring now to the drawings and more particularly to FIG. 1, an electrically-conductive spiral (referred to hereinafter as a "spiral conductor") is shown in plan view and is referenced generally by numeral 12. Spiral conductor 12 and its attributes are described in detail in U.S. Pat. No. 8,430,327, the entire contents of which are hereby incorporated by reference. Briefly, spiral conductor 12 is made from an electrically-conductive line, wire, run, trace, etc., arranged as a spiral winding between its ends 12A and 12B. For purposes of the present invention, spiral conductor 12 will generally lie in a plane. Spiral conductor 12 is constructed to have inductance and capacitance such that, in the presence of a time-varying electromagnetic field, spiral conductor 12 resonates to generate a harmonic electromagnetic field response. Techniques used to construct or deposit spiral conductor 12 on a substrate material can be any conventional metal-conductor deposition process to include thin-film fabrication techniques. In the illustrated embodiment, spiral conductor 12 is constructed to have a uniform trace width throughout (i.e., trace width W is constant) with a contiguous and uniform spacing or gap 12G (i.e., spacing D is constant) defined between adjacent portions of the spiral trace. For reasons that will be explained further below, trace width W and space width D are constant and equal for all of spiral conductor 12. However, it is to be understood spiral conductor 12 is not limited to a uniform-width conductor spirally wound with the same uniform-width spacing as illustrated in FIG. 1. Furthermore, the present invention is not limited to the rectangular-based spiral as it could be based on any regular or irregular geometric shape, although spirals based on regular geometric shapes are simpler to construct and configure for use in a plasma generator of the present invention.

Figure 2:
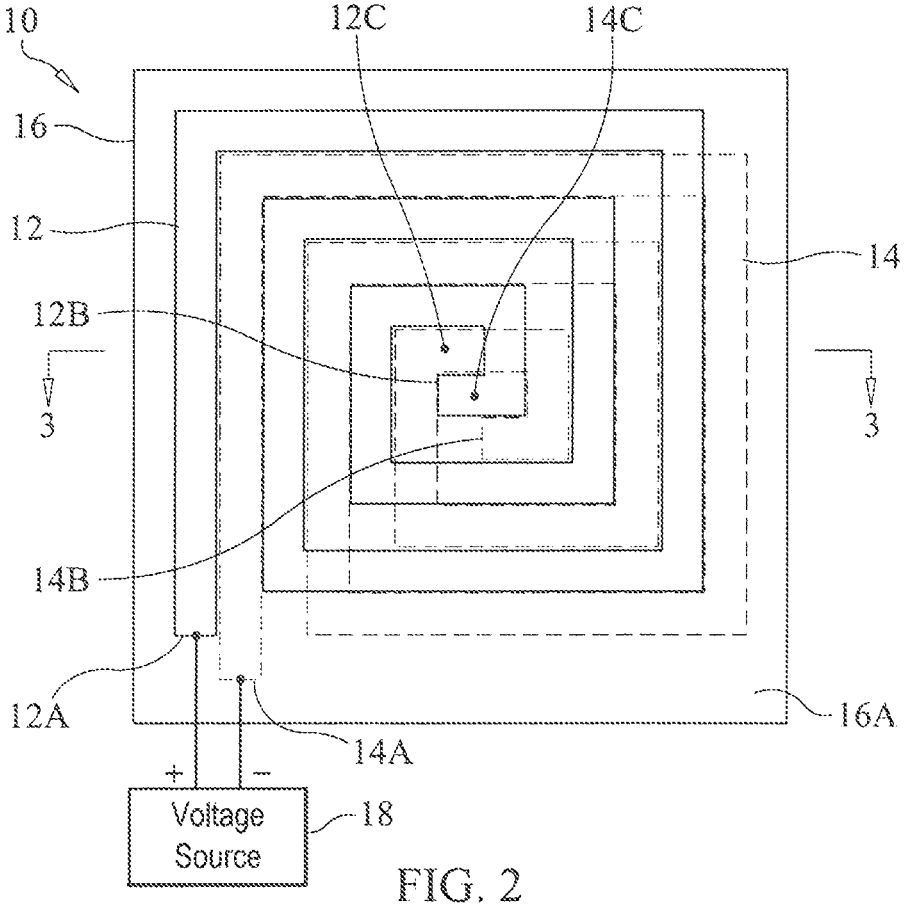
FIG. 2 is a part plan view and part schematic view of a plasma generator in accordance with an embodiment of the present invention.
Figure 3:
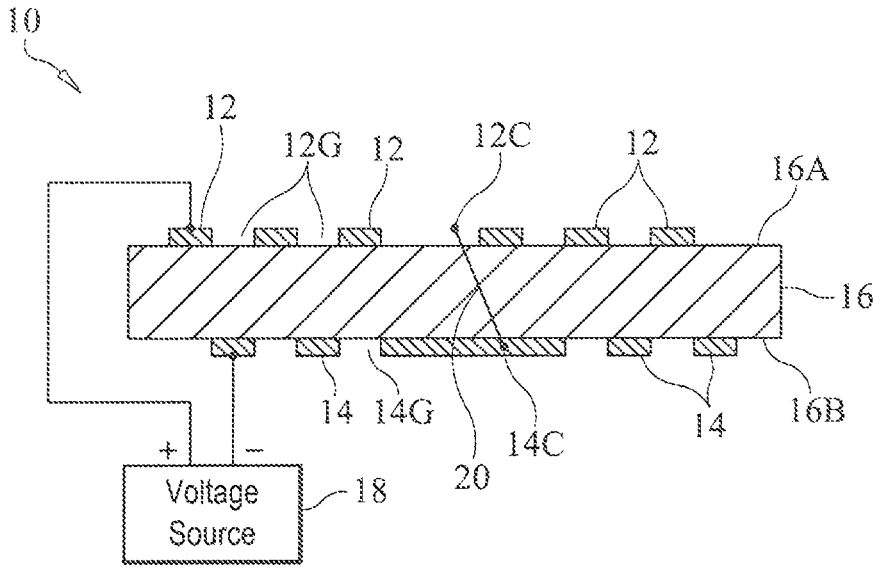
FIG. 3 is a cross sectional view taken along line 3-3 in FIG. 2 illustrating the spiraled electrical conductors separated by dielectric material.

Referring now simultaneously to FIGS. 2 and 3, an embodiment of a plasma generator in accordance with an embodiment of the present invention is shown and is referenced generally by numeral 10. Plasma generator 10 includes the above-described spiral conductor 12, a second spiral conductor 14 that is identical to spiral conductor 12, dielectric material 16 disposed between spiral conductors 12 and 14, and a voltage source 18 coupled across spiral conductors 12 and 14. For example, voltage source 18 can have its positive ("+") terminal coupled to end 12A of spiral conductor 12 and has its negative terminal ("−") coupled to end 14A of spiral conductor 14. Ends 12B and 14B of spiral conductors 12 and 14, respectively, remain electrically unconnected.

Dielectric material 16 is any solid (e.g., KAPTON®, TEFLON®, quartz, MACOR®, alumina, ceramics, glass, silicon, zirconium, barium titanate, barium strontium titanate, perovskite, etc.), liquid (e.g., water, hydrogen peroxide, liquid nitrogen, liquid oxygen, liquid fuels, petroleum, lubricants, etc.), gas (e.g., elemental gases such as helium, neon, argon, xenon, hydrogen, nitrogen, oxygen, fluorine, sodium, etc.), or combinations thereof (e.g., gas mixtures such as methane, water vapor, carbon dioxide, layers of solid dielectrics, layers of solid and liquid dielectrics, etc.) that serves as a dielectric material structure to electrically separate and isolate spiral conductor 12 from spiral conductor 14. In the illustrated embodiment, spiral conductor 12, dielectric material 16, and spiral conductor 14 are constructed to be in a fixed relationship with another. For example, spiral conductors 12/14 and dielectric material 16 can be a thin-film structure such that the combination of spiral conductors 12/14 and dielectric material 16 form a one-piece structure. In the illustrated embodiment of plasma generator 10, opposing surfaces 16A and 16B of dielectric material 16 define opposing planar and parallel surfaces on which spiral conductors 12 and 14 reside. That is, spiral conductors 12 and 14 are disposed in parallel planes. Dielectric material 16 (or some other protective electrical insulator) could be used to encase spiral conductors 12 and 14 without departing form the scope of the present invention.

Each of spiral conductors 12 and 14 has a geometric center indicated by reference numerals 12C and 14C, respectively. In accordance with the present invention, spiral conductors 12 and 14 partially overlap one another when viewed in a direction that is perpendicular to parallel opposing surfaces 16A and 16B. However, spiral conductors 12 and 14 are not in alignment with one another in the direction that is perpendicular to parallel opposing surfaces 16A and 16B. That is, spiral conductors 12 and 14 are shifted with respect to one another such that an imaginary line 20 (FIG. 3) connecting geometric centers 12C and 14C is non-perpendicular with respect to parallel opposing surfaces 16A and 16B. In this way, at least a portion of spiral conductor 12 overlaps at least a portion of the spacing or gap 14G associated with spiral conductor 14, and at least a portion of spiral conductor 14 overlaps a portion of the spacing or gap 12G associated with spiral conductor 12. For the illustrated embodiment, of constant and equal conductor width and gap width, spiral conductor 14 is shifted (relative to spiral conductor 12) by equal amounts in the X-Y plane such that the above-described conductor-to-gap overlap is substantially in one-to-one correspondence throughout the terrain occupied by spiral conductors 12 and 14. That is, in the illustrated example, the shift in the X and Y dimensions is equal to the conductor width W. However, it is to be understood that spiral conductor 14 could be shifted (relative to spiral conductor 12) in only the X-dimension, only the Y-dimension, in the X-Y plane with the amount of shift in the X-dimension being different than the amount of shift in the Y-dimension, and/or by amounts such that the conductor-to-gap overlap defines less than a one-to-one correspondence, without departing from the scope of the present invention.

Generally speaking, voltage source 18 is an electric voltage source that applies voltage across spiral conductors 12 and 14 such that plasma is generated in a portion of dielectric material 16. In the present invention, plasma is generated when spiral conductors 12 and 14 are energized such that a high voltage potential from voltage source 18 is established between spiral conductor 12 and spiral conductor 14. One spiral conductor (e.g., the positive one or spiral conductor 12 in the illustrated example) is the anode and the other spiral conductor (e.g., the negative one or spiral conductor 14 in the illustrated example) is the cathode. The voltage excitation may be in the form of direct current (DC) or alternating current (AC). Accordingly, the excitation frequency can vary from zero to very high frequencies.

The excitation energy must be sufficient to sustain the ionization of matter comprising dielectric 16. The amount of energy required can vary depending on the composition of the dielectric matter, but will typically be energized to levels in the thousands of volts. The high voltage pumps up the energy state of the atomic matter comprising the dielectric that, within microseconds, initiates a series of random discharges of electrons. Each electron carries with it an intrinsic negative charge. Newly freed from their parent atoms, the freed electrons and their associated negative charges build up on the positive (anode) side of the dielectric (e.g., surface 16A in the illustrated example). The remainder of the atom, missing at least one electron from its balanced state, now carries a positive charge and is called an ion. These positive charged ions migrate to the opposite (cathode) side of the dielectric (e.g., surface 16B in the illustrated example). The intense voltage induces the flow of more and more electrons (and ions) in a cascade event. One electron collides with an atom and liberates two additional electrons while creating one ion of the parent atom. The two newly liberated electrons are then free to each collide with two separate atoms, thus freeing four electrons while creating two more ions. This process rapidly continues generating more and more electrons and ions to thereby polarize the dielectric and stress the dielectric material beyond its dielectric limit. Once this occurs, dielectric material 16 can no longer effectively store charge between surfaces 16A and 16B such that dielectric material 16 rapidly transforms from being an insulator to a conductor composed almost entirely of free electrons and ions as it becomes increasingly ionized. The above-described continuous discharge process causes the emissions of energetic photons and the ionization visibly reveals itself to be a plasma by the colored glow that corresponds to the type and composition of dielectric material 16.

In the illustrated embodiment, where there is a one-to-one conductor-to-gap overlap correspondence, the plasma glow will occur along the pattern of the spiral. This is a function of the geometry of spiral conductors 12 and 14 (i.e., both the anode and the cathode) and the mean free path the electrons take through dielectric 16 to travel from one energized spiral conductor to the other. The initial discharge between the spiral conductors is governed by Paschen's Law. In the space of the parallel gaps defined between the conductive portions of spiral conductors 12 and 14, a large number of individual tiny channels (referred to as micro-discharges) occur. At surfaces 16A and 16B of dielectric 16, the micro-discharge channels spread into surface discharges. This cascades very quickly into a visible-glow discharge plasma covering a much larger space. The visible plasma follows the strength of the electric field generated by spiral conductors 12 and 14. The shape of the electric field is itself in the shape of the spiral conductors.

In general, the shaping of the spirals and their relative positions in their respective parallel planes provides the basis to design a plasma generator whose resonance frequencies are both variable and tunable. The shaped conduction paths of the spirals provide for the construction of reconfigurable circuit paths and circuit elements such as resistors, capacitors, inductors, switches, etc. Several plasma generators of various sizes and shapes could be organized in an array and the positioning of multiple spirals could serve as controllable pixels (e.g., in a plasma television screen) to continuously "paint" reconfigurable patterns on or around a surface. These changeable patterns would not only radiate visible light of varying color, but could also radiate signals comprising radio frequencies, microwave frequencies, millimeter wave frequencies, infrared "light", and/or ultraviolet "light". The signals could be output in patterns of controllable tuned resonances that would have profound design implications for antenna phased arrays, flow control arrays, thermal arrays, and sensing arrays. The plasma generator of the present invention could also be used to provide hydrodynamic and aerodynamic variable flow control over a surface. Still further, the plasma generator of the present invention could be used to provide thermal control in, over, and/or around a shaped area.

Voltage source 18 can be a controllable voltage source so that plasma generator 10 can be turned on and off as needed. This allows for the device to be modulated with simple on/off as well as complex modulation schemes of various frequencies, amplitudes, phases, and duty cycles. It is to be understood that voltage source 18 could also output its voltage as waveforms similar to those provided by a function generator, such that the applied voltage is modulated with pulses, sine waves, square waves, sawtooth waves, noise, or arbitrary waveforms. The modulation is similarly impressed upon the generated plasma such that signals, intelligence, or information can be transferred by the plasma into the surrounding media. In addition, a controllable voltage source 18 can be used to tune plasma generator 10. For example, by incrementally increasing or decreasing the intensity of the voltage, the size and characteristics of the plasma forming on spiral conductors 12 and 14 will change. As a result, a virtual spiral plasma of varying geometry, trace width W, and gap width D can be formed and controlled electronically. Such control will manifest itself as frequency agility in the harmonic electromagnetic field response of plasma generator 10.

Voltage source 18 is not limited to man-made or controllable voltage sources. That is, depending on the application, voltage source 18 could also be a naturally-occurring source of high voltage (e.g., lightning, Earth's plasmasphere, Jupiter-Io flux, space plasmas, etc.) without departing from the scope of the present invention.

Figure 4:
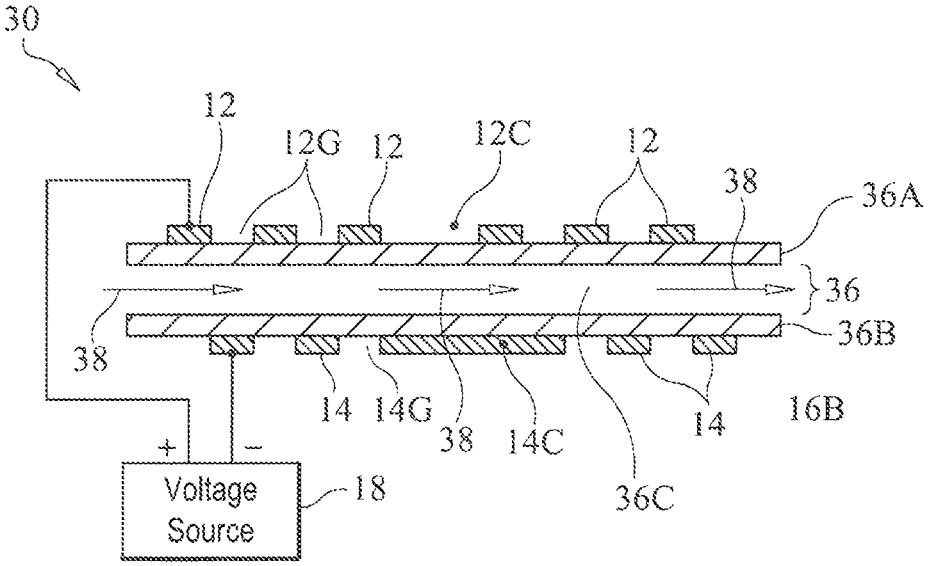
FIG. 4 is a part schematic and part cross-sectional view of a plasma generator in accordance with another embodiment of the present invention, in which the spiraled electrical conductors are separated by a dielectric material that includes a moving or flowing portion.

Another embodiment of a plasma generator 30 in accordance with the present invention is illustrated in FIG. 4 where a dielectric region 36 between spiral conductors 12 and 14 includes solid dielectric substrates 36A and 36B on which spiral conductors 12 and 14, respectively, are mounted. A moving or flowing dielectric region 36C moves/flows between dielectric substrates 36A/36B as indicated by flow arrows 38. Plasma generator 30 can be designed such that it only generates a plasma in dielectric region 36C when a certain material (e.g., liquid, gas, etc.) is present when spiral conductors 12 and 14 are energized by voltage source 18. In this way, plasma generator 30 can be used to sense the presence of a particular material in flow 38. The mechanism of plasma generation is the same as described earlier herein.

The advantages of the present invention are numerous. The simple plasma generator lends itself to thin-film fabrication techniques. The plasma generator can be used in a variety of sensing, antenna, current-conducting, and lighting applications. The plasma generator can be tuned by making simple changes to one or more of the spiral conductors and/or the shifts associated therewith, the separating dielectric material, and the voltage source and the voltage supplied thereby.

What is claimed is:

1. A plasma generator, comprising:

a first electrical conductor having first and second ends, said first electrical conductor shaped to form a first spiral between said first and second ends thereof, said first spiral lying in a first plane, said first spiral having a geometric center, said first electrical conductor so-shaped having inductance and capacitance wherein, in the presence of a time-varying electromagnetic field, said first electrical conductor so-shaped resonates to generate a harmonic electromagnetic field response;

a second electrical conductor having first and second ends, said second electrical conductor shaped to form a second spiral between said first and second ends thereof, said second spiral being identical to said first spiral and lying in a second plane parallel to said first plane, said second spiral having a geometric center, said second electrical conductor so-shaped having inductance and capacitance wherein, in the presence of a time-varying electromagnetic field, said second electrical conductor so-shaped resonates to generate a harmonic electromagnetic field response;

said first spiral and said second spiral partially overlapping one another in a direction perpendicular to said first plane and said second plane;

said geometric center of said first spiral and said geometric center of said second spiral defining endpoints of a line, wherein said line is non-perpendicular with respect to said first plane and said second plane;

dielectric material disposed between said first electrical conductor and said second electrical conductor; and a voltage source coupled across said first electrical conductor and said second electrical conductor for applying a voltage sufficient to generate a plasma in at least a portion of said dielectric material.

2. The plasma generator of claim 1, wherein said dielectric material comprises at least one of a solid, a liquid, and a gas.

3. The plasma generator of claim 1, wherein said first electrical conductor, said second electrical conductor, and said dielectric material are maintained in a fixed relationship.

4. The plasma generator of claim 1, wherein said first electrical conductor and said second electrical conductor are maintained in a fixed relationship.

5. The plasma generator of claim 1, wherein said first spiral and said second spiral are based on a regular geometric shape.

6. The plasma generator of claim 1, wherein said first spiral defines a contiguous gap between spiral portions of said first electrical conductor, and wherein widths of said first electrical conductor and said contiguous gap are constant and equal.

7. The plasma generator of claim 1, wherein said second spiral defines a contiguous gap between spiral portions of said second electrical conductor, and wherein widths of said second electrical conductor and said contiguous gap are constant and equal.

8. The plasma generator of claim 1, wherein said first spiral defines a first contiguous gap between spiral portions of said first electrical conductor, wherein said second spiral defines a second contiguous gap between spiral portions of said second electrical conductor, and wherein widths of said first electrical conductor, said first contiguous gap, said second electrical conductor, and said second contiguous gap are constant and equal.

9. The plasma generator of claim 1, wherein said first electrical conductor, said second electrical conductor, and said dielectric material comprise a one-piece structure.

10. The plasma generator of claim 1, wherein said voltage source is controllable.

11. A plasma generator, comprising:

a first electrical conductor arranged in a first spiral pattern with a first contiguous gap being defined between adjacent portions of said first electrical conductor wherein widths of said first electrical conductor and said first contiguous gap are constant and equal, said first electrical conductor lying in a first plane, said first electrical conductor so-arranged having inductance and capacitance wherein, in the presence of a time-varying electromagnetic field, said first electrical conductor so-arranged resonates to generate a harmonic electromagnetic field response;

a second electrical conductor arranged in a second spiral pattern identical to said first spiral pattern wherein a second contiguous gap is defined between adjacent portions of said second electrical conductor and wherein widths of said second electrical conductor and said second contiguous gap are constant and equal, said second electrical conductor lying in a second plane parallel to said first plane, said second electrical conductor so-arranged having inductance and capacitance wherein, in the presence of a time-varying electromagnetic field, said second electrical conductor so-arranged resonates to generate a harmonic electromagnetic field response;

said first spiral pattern and said second spiral pattern partially overlapping one another wherein, in a direction perpendicular to said first plane and said second plane, portions of said first electrical conductor overlap portions of said second contiguous gap and wherein portions of said second electrical conductor overlap portions of said first contiguous gap;

dielectric material disposed between said first electrical conductor and said second electrical conductor; and a voltage source coupled across said first electrical conductor and said second electrical conductor for applying a voltage sufficient to generate a plasma in said dielectric material.

12. The plasma generator of claim 11, wherein said dielectric material comprises at least one of a solid, a liquid, and a gas.

13. The plasma generator of claim 11, wherein said first electrical conductor, said second electrical conductor, and said dielectric material are maintained in a fixed relationship.

14. The plasma generator of claim 11, wherein said first electrical conductor and said second electrical conductor are maintained in a fixed relationship.

15. The plasma generator of claim 11, wherein said first spiral pattern and said second spiral pattern are based on a regular geometric shape.

16. The plasma generator of claim 11, wherein said first electrical conductor, said second electrical conductor, and said dielectric material comprise a one-piece structure.

17. The plasma generator of claim 11, wherein said voltage source is controllable.

18. The plasma generator of claim 11, wherein said first electrical conductor, said second electrical conductor, and said dielectric material are maintained in a fixed relationship within a one-piece structure.

19. A plasma generator, comprising:

a pair of identical spiraled electrical conductors, each of said spiraled electrical conductors having inductance and capacitance wherein, in the presence of a time-varying electromagnetic field, each of said spiraled electrical conductors resonates to generate a harmonic electromagnetic field response, said spiraled electrical conductors residing in parallel planes and partially overlapping one another in a direction perpendicular to said parallel planes, each of said spiraled electrical conductors having a geometric center wherein each said geometric center defines an endpoint of a line that is non-perpendicular with respect to said parallel planes;

dielectric material disposed between said spiraled electrical conductors; and a voltage source coupled across said spiraled electrical conductors for applying a voltage sufficient to generate a plasma in at least a portion of said dielectric material.

20. The plasma generator of claim 19, wherein said dielectric material comprises at least one of a solid, a liquid, and a gas.

21. The plasma generator of claim 19, wherein said spiraled electrical conductors and said dielectric material are maintained in a fixed relationship.

22. The plasma generator of claim 19, wherein said spiraled electrical conductors are maintained in a fixed relationship.

23. The plasma generator of claim 19, wherein said spiraled electrical conductors are based on a regular geometric shape.

24. The plasma generator of claim 19, wherein each of said spiraled electrical conductors is defined by a contiguous gap between spiral portions of an electrical conductor, wherein said widths of said electrical conductor and said contiguous gap are constant and equal.

25. The plasma generator of claim 19, wherein said spiraled electrical conductors and said dielectric material comprise a one-piece structure.

26. The plasma generator of claim 19, wherein said voltage source is controllable.

* * * * *